US008225842B2

(12) United States Patent
Taniguchi

(10) Patent No.: US 8,225,842 B2
(45) Date of Patent: Jul. 24, 2012

(54) DIE CASTING MACHINE

(75) Inventor: Yoshiya Taniguchi, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 60 days.

(21) Appl. No.: 13/002,397

(22) PCT Filed: Jul. 2, 2009

(86) PCT No.: PCT/JP2009/062133
§ 371 (c)(1),
(2), (4) Date: Jan. 3, 2011

(87) PCT Pub. No.: WO2010/001963
PCT Pub. Date: Jan. 7, 2010

(65) Prior Publication Data

US 2011/0094702 A1 Apr. 28, 2011

(30) Foreign Application Priority Data

Jul. 4, 2008 (JP) ..... 2008-175883

(51) Int. Cl.
*B22D 17/00* (2006.01)
*B22D 17/32* (2006.01)

(52) U.S. Cl. ..... 164/312; 164/303

(58) Field of Classification Search ..... 164/303, 164/312, 313, 314, 315
See application file for complete search history.

(56) References Cited

U.S. PATENT DOCUMENTS 6,581,670 B1 6/2003 Fink et al.
7,011,511 B2 * 3/2006 Nishizawa et al. ..... 425/145
7,168,946 B2 * 1/2007 Koike et al. ..... 425/595
7,373,777 B2 * 5/2008 Koike et al. ..... 60/560
7,717,159 B2 * 5/2010 Tsuji et al. ..... 164/312

FOREIGN PATENT DOCUMENTS

JP 3-278933 A 12/1991
JP 2003-500219 A 1/2003
JP 2008-114246 A 5/2008

OTHER PUBLICATIONS

International Search Report dated Aug. 25, 2009 with English translation (two (2) pages).

* cited by examiner

*Primary Examiner* — Kevin P Kerns
(74) *Attorney, Agent, or Firm* — Crowell & Moring LLP

(57) ABSTRACT

Provided is an electric die casting machine capable of achieving high injection speed and high boost pressure. An injection unit (100) is provided with an electric servomotor (104) for injection in a first stage, a ball screw mechanism (110) (motion converting mechanism in the first stage) for converting rotational motion of the electric servomotor for injection in the first stage into rectilinear motion of a linear motion body (106), electric servomotors (111 and 112) for injection in a second stage, mounted on the linear motion body, a crank mechanism (113 and 116) (motion converting mechanism in the second stage) for converting rotational motion of the electric motor servomotor for injection in the second stage into rectilinear motion of an injection plunger (118), and a control unit (400) for controlling driving of each electric servomotor for injection. The control unit drives only the electric servomotor (104) for injection in the first stage independently in a low-speed injection step, and drives both the electric servomotor (104) for injection in the first stage and the electric servomotors (111 and 112) for injection in the second stage simultaneously in a high-speed injection step and a pressure intensification step.

3 Claims, 16 Drawing Sheets

DIE CASTING MACHINE

TECHNICAL FIELD

The present invention relates to a die casting machine provided with an injection unit driven by electric servomotors, and particularly relates to a motion converting mechanism for converting rotational motion of electric servomotors into rectilinear motion of an injection plunger.

BACKGROUND ART

In a die casting machine, a molten metal material (metal melt) such as an Al alloy or a Mg alloy melted in a melting furnace is measured and scooped every shot by a ladle. The scooped metal melt is poured into an injection sleeve. The metal melt is then injected/filled into a cavity of a mold in accordance with forward movement of an injection plunger. Thus, a product is obtained.

The casting procedure of the die casting machine includes an injection step consisting of a low-speed injection step and a high-speed injection step following the low-speed injection step, and a pressure intensification step following the high-speed injection step. The high-speed injection step requires a higher injection speed than that of injection molding of a plastic material. In addition, the pressure intensification step requires a higher boosting force than that of injection molding of a plastic material. Accordingly, a comparatively large-scale hydraulic drive source is heretofore generally used as a drive source for injection/pressure boosting. In addition, since the comparatively large-scale hydraulic drive source is provided, the hydraulic drive sources are often used as drive sources for opening/closing a mold or extruding a cast product.

However, such a hydraulic die casting machine is apt to contaminate a factory with oil. Therefore, there is an increasing request for an electric die casting machine to keep a factory clean. In order to cope with such a request, the present applicant has already proposed a die casting machine including a crank mechanism in which a first arm is rotationally driven by an electric servomotor and an injection plunger is rotatably linked with a front end of a second arm one end of which is rotatably linked with the first arm (see Patent Document 1). In this die casting machine, the crank mechanism is set in advance so that the high-speed injection step can be carried out in a rotational angle range where the relative speed of the injection plunger is the highest, and the pressure intensification step can be carried out in a rotational angle range where the magnifying ratio of force acting on the injection plunger is the highest. Thus, products can be cast without use of any hydraulic drive source.

Patent Document 1: JP-A-2008-114246

SUMMARY OF THE INVENTION

Problem that the Invention is to Solve

However, according to the technique disclosed in Patent Document 1, only a pair of an electric servomotor for injection and a crank mechanism to be rotationally driven by the electric servomotor is provided. Therefore, there is a problem that it is difficult to apply the technique to a large-scale die casting machine which is required to further increase the injection speed and further increase the boosting pressure.

The present invention was developed in consideration of the aforementioned problem. An object of the invention is to provide an electric die casting machine which can obtain a high injection speed and a high boosting pressure.

Means for Solving the Problem

In order to attain the object, a first configuration of the invention is made to include: an electric servomotor for injection in a first stage, which is fixed to a motor mounting plate; a motion converting mechanism in the first stage, which converts rotational motion of the electric servomotor for injection in the first stage into rectilinear motion of a linear motion body; an electric servomotor for injection in a second stage, which is mounted on the linear motion body; a motion converting mechanism in the second stage, which converts rotational motion of the electric servomotor for injection in the second stage into rectilinear motion of an injection plunger; and a control unit which controls driving of each of the electric servomotors for injection; wherein: the control unit drives only the electric servomotor for injection in the first stage independently in a low-speed injection step, and drives both the electric servomotor for injection in the first stage and the electric servomotor for injection in the second stage simultaneously in a high-speed injection step and a pressure intensification step.

With this configuration, the injection plunger can be moved forward in accordance with the total speed of the forward speed of the linear motion body caused by the rotational driving of the electric servomotor for injection in the first stage and the forward speed of the injection plunger caused by the electric servomotor for injection in the second stage. Thus, the injection speed can be made higher. In addition, the injection plunger can be moved forward in accordance with the total pressure of the pressure of the linear motion body caused by the rotational driving of the electric servomotor for injection in the first stage and the pressure of the injection plunger caused by the rotational driving of the electric servomotor for injection in the second stage. Thus, the injection pressure and the boosting pressure can be increased.

A second configuration of the invention is made in such a manner that one of the motion converting mechanism in the first stage and the motion converting mechanism in the second stage is a crank mechanism which includes a first arm and a second arm, the first arm being rotationally driven by the electric servomotor for injection in the first stage or the electric servomotor for injection in the second stage, the second arm having one end rotatably linked with the first arm and the other end rotatably linked with the linear motion body or the injection plunger.

The crank mechanism is different from a ball screw mechanism. A movable part of the crank mechanism does not slide in the axial direction of a shaft and the crank mechanism has high tolerance against dust. Accordingly, when the crank mechanism is applied to the die casting machine in which fine dust of a metal material or atomized liquid of a release agent sprayed to a releasing surface of a mold may fly around in operation, the life of the motion converting mechanism can be extended, and the maintenance thereof can be made easier.

A third configuration of the invention is made in such a manner that an initial position of the crank mechanism is set so that the high-speed injection step can be carried out in a rotational angle range of the first arm where a relative speed of the linear motion body or the injection plunger is the highest, and the pressure intensification step can be carried out in a rotational angle range of the first arm where a magnifying ratio of force acting on the linear motion body or the injection plunger is the highest.

Assume that a rotation angle θ of the crank shaft is 0□ when a pin connection portion between the first arm and the second arm, a rotation center of the first arm and a pin connection portion between the second arm and a linear motion member (linear motion body or injection plunger) are arranged in a straight line in this order in the crank mechanism. In this case, the moving speed of the linear motion member is the highest at θ=90□, and the moving speed of the linear motion member is lower as the rotation angle θ is closer to 0□ or 180□. The pressure acting on the linear motion member changes inversely with the moving speed. Higher pressure can act on the linear motion member as the rotation angle θ is closer to 0□ or 180□, and the pressure acting on the linear motion member becomes the lowest at θ=90□. Therefore, when the position of θ=180□ is set in consideration of such a characteristic of the crank mechanism, the high-speed injection step and the pressure intensification step can be carried out with high efficiency.

Effect of the Invention

The die casting machine according to the invention includes: an electric servomotor for injection in a first stage; a motion converting mechanism in the first stage; an electric servomotor for injection in a second stage; a motion converting mechanism in the second stage; and a control unit which controls driving of the electric servomotors for injection in the respective stages; wherein: the control unit drives only the electric servomotor for injection in the first stage independently in a low-speed injection step; and drives both the electric servomotor for injection in the first stage and the electric servomotor for injection in the second stage simultaneously in a high-speed injection step and a pressure intensification step. Accordingly, the injection speed can be made higher, and the injection pressure and the boosting pressure can be increased.

MODE FOR CARRYING OUT THE INVENTION

An embodiment of a die casting machine according to the invention will be described below with reference to the drawings.

Figure 1:
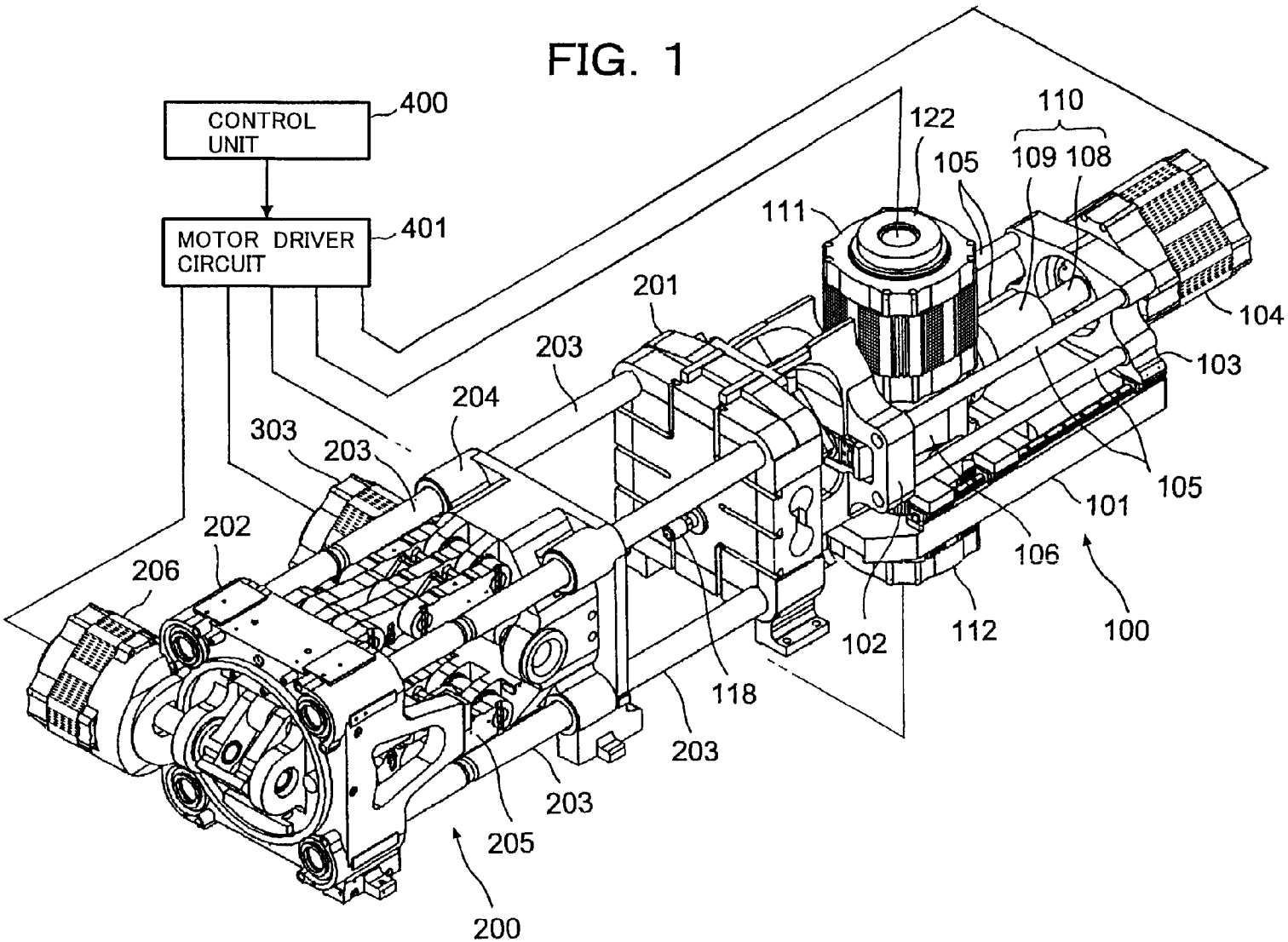
[FIG. 1] A perspective view of a main part of a die casting machine according to an embodiment.
Figure 2:
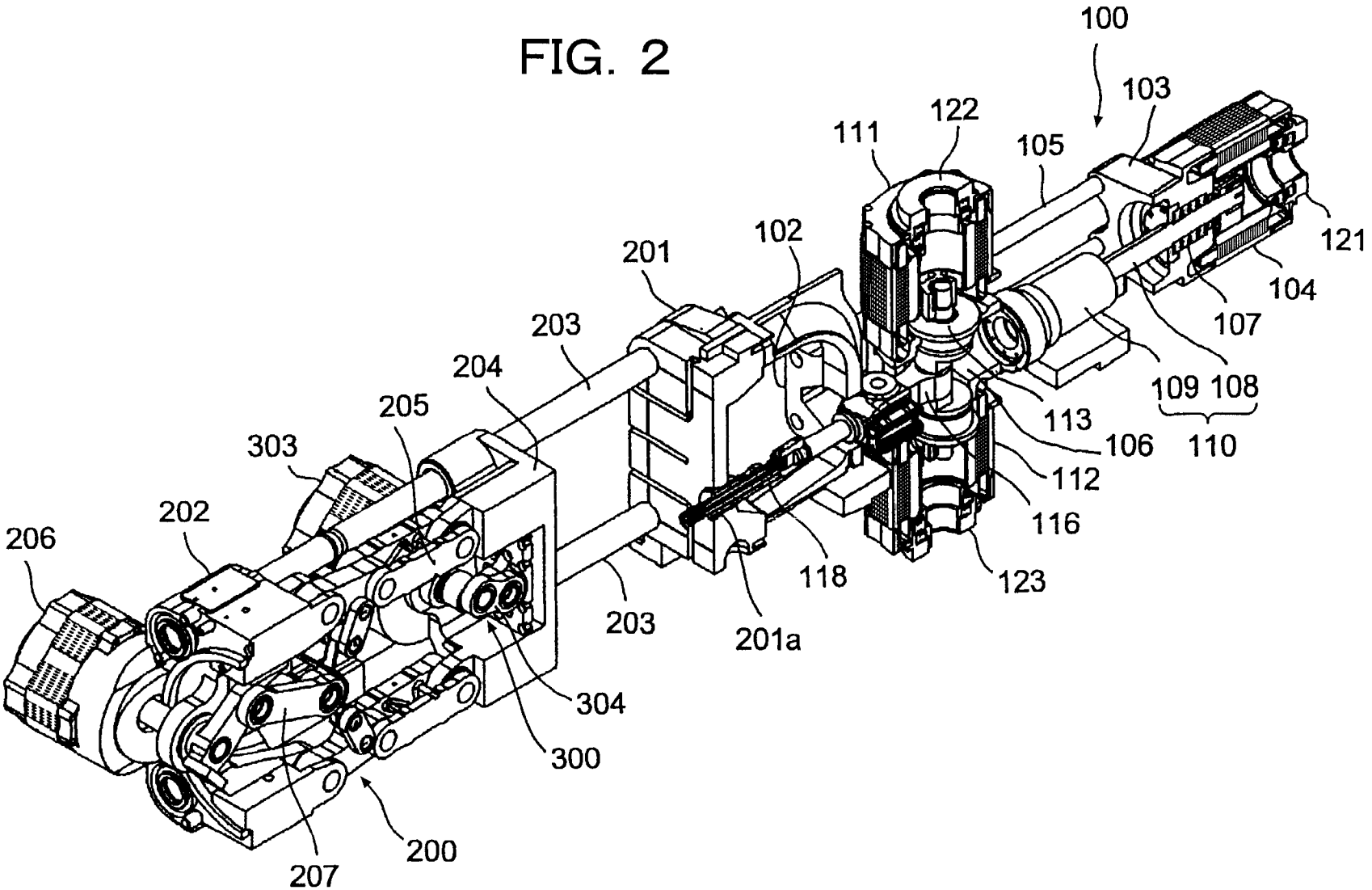
[FIG. 2] A perspective sectional view showing an internal structure of the die casting machine according to the embodiment.
Figure 3:
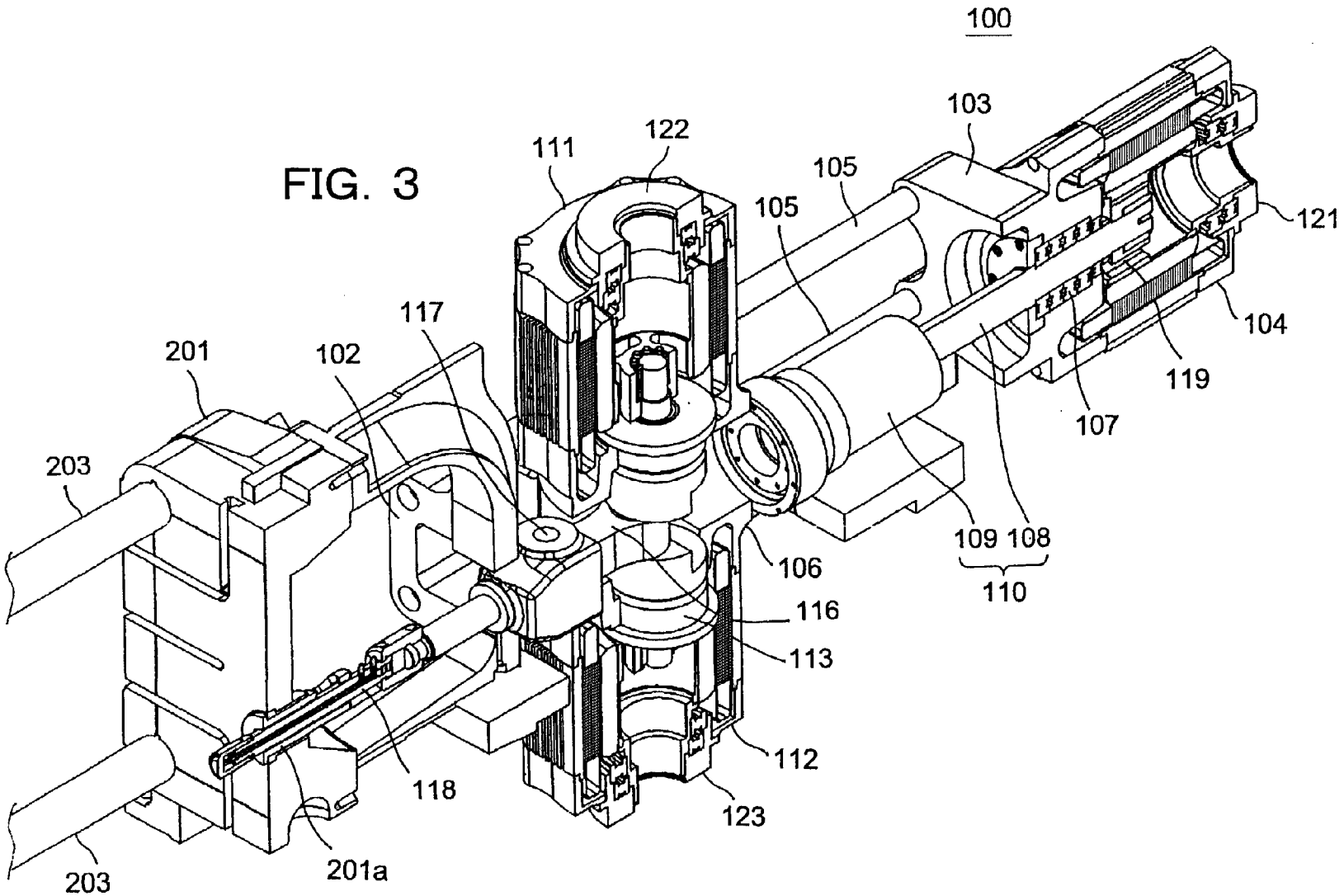
[FIG. 3] A perspective sectional view showing an internal structure of an injection unit according to the embodiment.

FIG. 1 is a perspective view of a main part of the die casting machine according to the embodiment. FIG. 2 is a perspective sectional view showing an internal structure of the die casting machine according to the embodiment. As shown in these drawings, the die casting machine according to the embodiment has an injection unit 100, a mold clamping unit 200, an ejecting unit 300, a control unit 400 for controlling driving of electric servomotors provided in these units respectively, and a driver circuit 401 for driving the respective electric servomotors in accordance with a command signal outputted from the control unit 400.

First, description will be made on the injection unit 100 of the die casting machine according to the embodiment.

As shown in FIGS. 1 to 4, the injection unit 100 is chiefly constituted by a head stock 102, a motor mounting plate 103, a first injection servomotor (servomotor for injection in a first stage) 104, four connection bars 105, a linear motion body 106, a ball screw mechanism (motion converting mechanism in the first stage) 110, second and third injection servomotors (servomotors for injection in a second stage) 111 and 112, a first arm 113, a second arm 116, a crank mechanism (motion converting mechanism in the second stage) and an injection plunger 118. The head stock 102 and the motor mounting plate 103 are disposed in opposition to each other and at a predetermined distance from each other on an injection unit base 101. The first injection servomotor 104 is attached to the motor mounting plate 103. The four connection bars 105 are put between the head stock 102 and the motor mounting plate 103. The linear motion body 106 is guided by the connection bars 105 so as to move forward/backward between the head stock 102 and the motor mounting plate 103. The ball screw mechanism 110 is constituted by a screw shaft 108 and a nut body 109. The screw shaft 108 is rotatably retained in the motor mounting plate 103 through a bearing 107 so as to be rotationally driven by the first injection servomotor 104. The nut body 109 is screwed on the screw shaft 108, and has one end fixed to the linear motion body 106. The second and third injection servomotors 111 and 112 are attached to the upper and lower surfaces of the linear motion body 106. The first arm 113 is rotatably retained in the linear motion body 106 through a not-shown bearing so as to be rotationally driven by the second and third injection servomotors 111 and 112. One end of the second arm 116 is rotatably pin-connected to a first connecting shaft 115 (see FIGS. 5 to 7). The crank mechanism is constituted by the second arm 116. The injection plunger 118 is rotatably pin-connected to a front end of the second arm 116 through a connecting pin 117. In order to avoid bad effect of dust or atomized liquid, it is particularly desirable that a sealed bearing is used as the bearing of each pin-connection portion. In addition, rotary encoders 121, 122 and 123 as rotation angle detecting sensors are provided in the first to third injection servomotors 104, 111 and 112 respectively.

Figure 4:
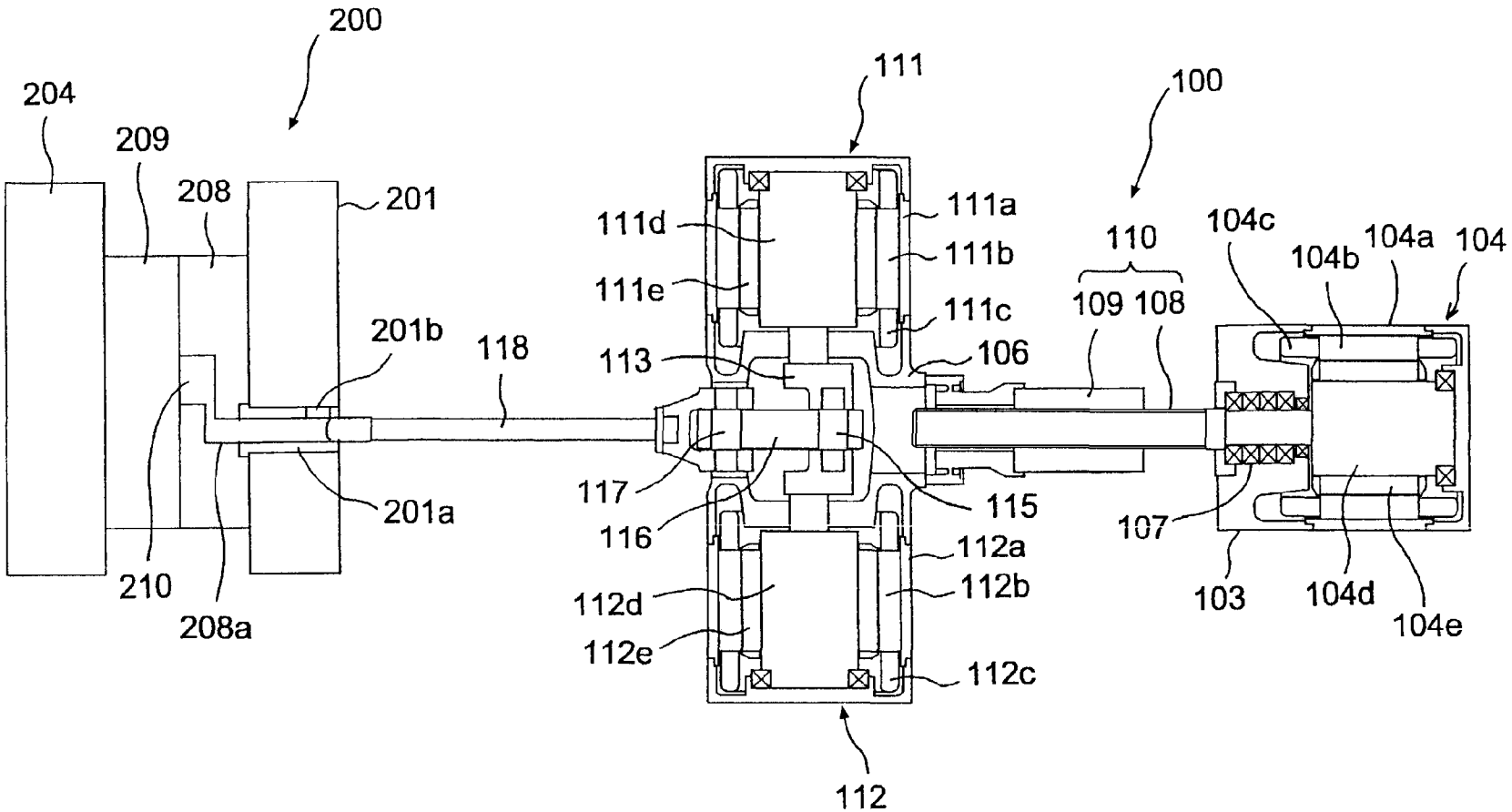
[FIG. 4] A sectional view showing the internal structure of the injection unit according to the embodiment.

As shown in FIG. 4, the first injection servomotor 104 is constituted by a casing 104*a*, a cylindrical motor stator 104*b* fixed to an inner surface of the casing 104*a*, a motor coil 104*c* wound around an outer circumference of the motor stator 104*b*, a cylindrical motor rotor 104*d* disposed in the motor stator 104*b*, and a motor magnet 104*e* attached to an outer surface of the motor rotor 104*d*. The screw shaft 108 is connected to an inner surface of the motor rotor 104*d* through a connecting member 119. Accordingly, when a motor drive current outputted from the driver circuit 401 based on a command signal of the control unit 400 is applied to the first injection servomotor 104, the screw shaft 108 is rotationally driven with the motor rotor 104*d* and the connecting member 119 so that the linear motion body 106 is moved in the axial direction of the screw shaft 108 with the nut body 109 on down to the screw shaft 108.

Likewise, as shown in FIG. 4, the second injection servomotor 111 is constituted by a casing 111*a*, a cylindrical motor stator 111*b* fixed to an inner surface of the casing 111*a*, a motor coil 111*c* wound around an outer circumference of the motor stator 111*b*, a cylindrical motor rotor 111*d* disposed in the motor stator 111*b*, and a motor magnet 111*e* attached to an outer surface of the motor rotor 111*d*, and the third injection servomotor 112 is constituted by a casing 112*a*, a cylindrical motor stator 112*b* fixed to an inner surface of the casing 112*a*, a motor coil 112*c* wound around an outer circumference of the motor stator 112*b*, a cylindrical motor rotor 112*d* disposed in the motor stator 112*b*, and a motor magnet 112*e* attached to an outer surface of the motor rotor 112*d*. The motor rotors 111*d* and 112*d* of the second and third injection servomotors 111 and 112 are connected to the first arm 113. Accordingly, when a motor drive current outputted from the driver circuit 401 based on a command signal of the control unit 400 is applied to the second and third injection servomotors 111 and 112, the first arm 113 is rotationally driven by the motor rotors 111*d* and 112*d* so that the plunger 118 is moved in the axial direction of the screw shaft 108 with the second arm 116 connected to the first arm 113.

Figure 5:
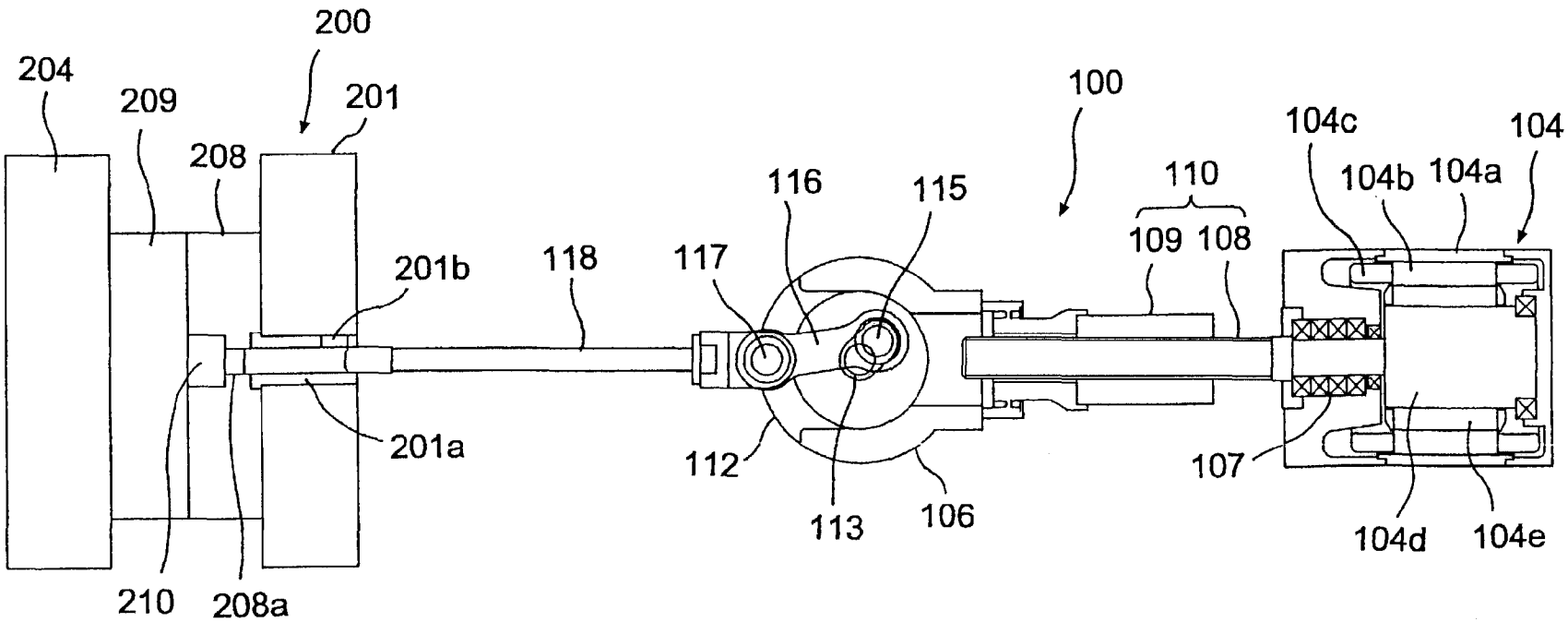
[FIG. 5] A sectional view showing a state where the injection unit according to the embodiment is on standby.
Figure 6:
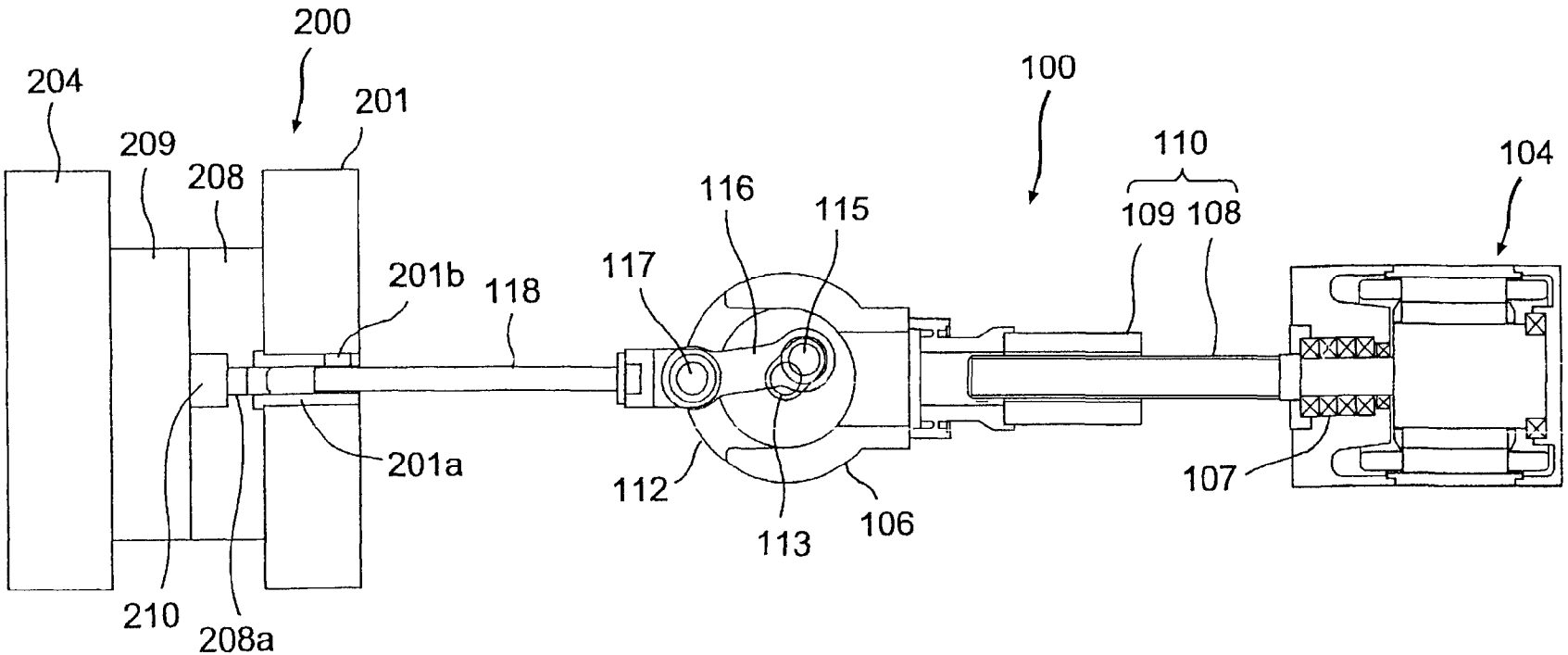
[FIG. 6] A sectional view showing a state where the injection unit according to the embodiment is serving for injection.
Figure 7:
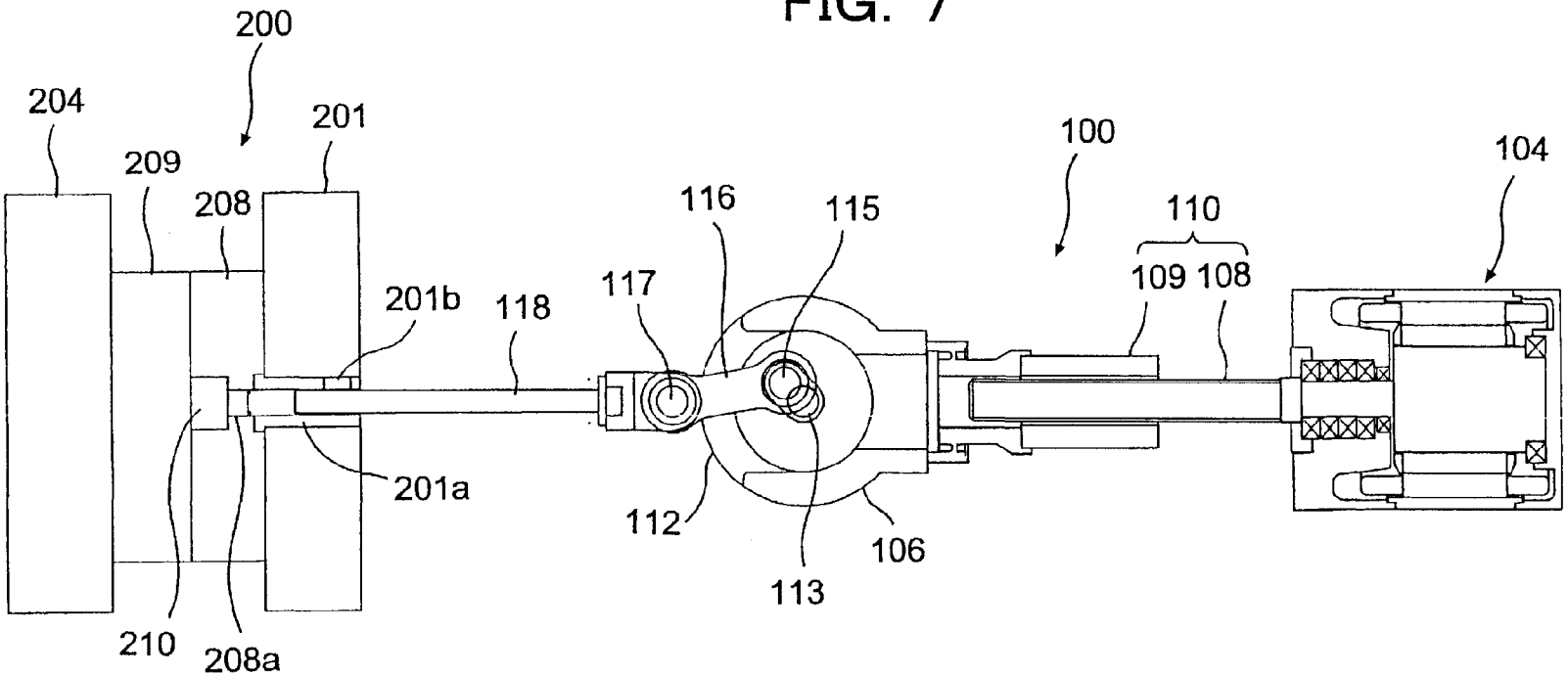
[FIG. 7] A sectional view showing a state where the injection unit according to the embodiment has finished the injection.

A front end portion of the plunger 118 is slidably received in a sleeve 201*a* fixed to a fixed die plate 201 which is a constituent of the mold clamping unit 200 as shown in FIGS. 5 to 7. In addition, a melt injection hole 201*b* communicating with the inside of the sleeve 201*a* is provided in the fixed die plate 201. Thus, when the plunger 118 is moved forward after melt is injected into the sleeve 201*a* through the melt injection hole 201*b* in the state that the plunger 118 is moved back, the melt injected into the sleeve 201*a* is injected into a mold cavity 210 which is formed by clamping a fixed mold 208 and a movable mold 209, through a runner 208*a* provided in the fixed mold 208. In this manner, die-casting of a molded piece with a desired shape is performed.

This point will be described more in detail. In a standby position shown in FIG. 5, the nut body 109 of the ball screw mechanism 110 has moved to a base end side (first injection servomotor 104 side) of the screw shaft 108, and the first connecting shaft 115 of the first arm 113 has been stopped in an upper right direction of 45□ in view from the rotation center of the first arm 113. As soon as an injection step is started, a motor drive current outputted from the driver circuit 401 based on a command signal of the control unit 400 is applied to the first injection servomotor 104 so that the motor rotor 104*d* and the screw shaft 108 rotate integrally. In this manner, as shown in FIG. 6, the nut body 109, the linear motion body 106, the second and third injection servomotors 111 and 112, and the plunger 118 move integrally to the front end side (mold side).

When the amount of rotation of the first injection servomotor 104 reaches a predetermined value, a motor drive current outputted from the driver circuit 401 based on a command signal of the control unit 400 is applied to the second and third injection servomotors 111 and 112 so that the motor rotors 111*d* and 112*d* and the first arm 113 rotate integrally. In this manner, as shown in FIG. 7, the second arm 116 and the plunger 118 move integrally to the front end side. In this embodiment, the second and third injection servomotors 111 and 112 are rotationally driven until the first connecting shaft 115 reaches an upper left direction of 45□ in view from the rotation center of the first arm 113. In this manner, the second arm 116 and the plunger 118 can be moved to the front end side at a high speed when the first connecting shaft 115 is moved to the upper left direction of 45□ from the upper right direction of 45□ in view from the rotation center of the first arm 113.

Figure 8:
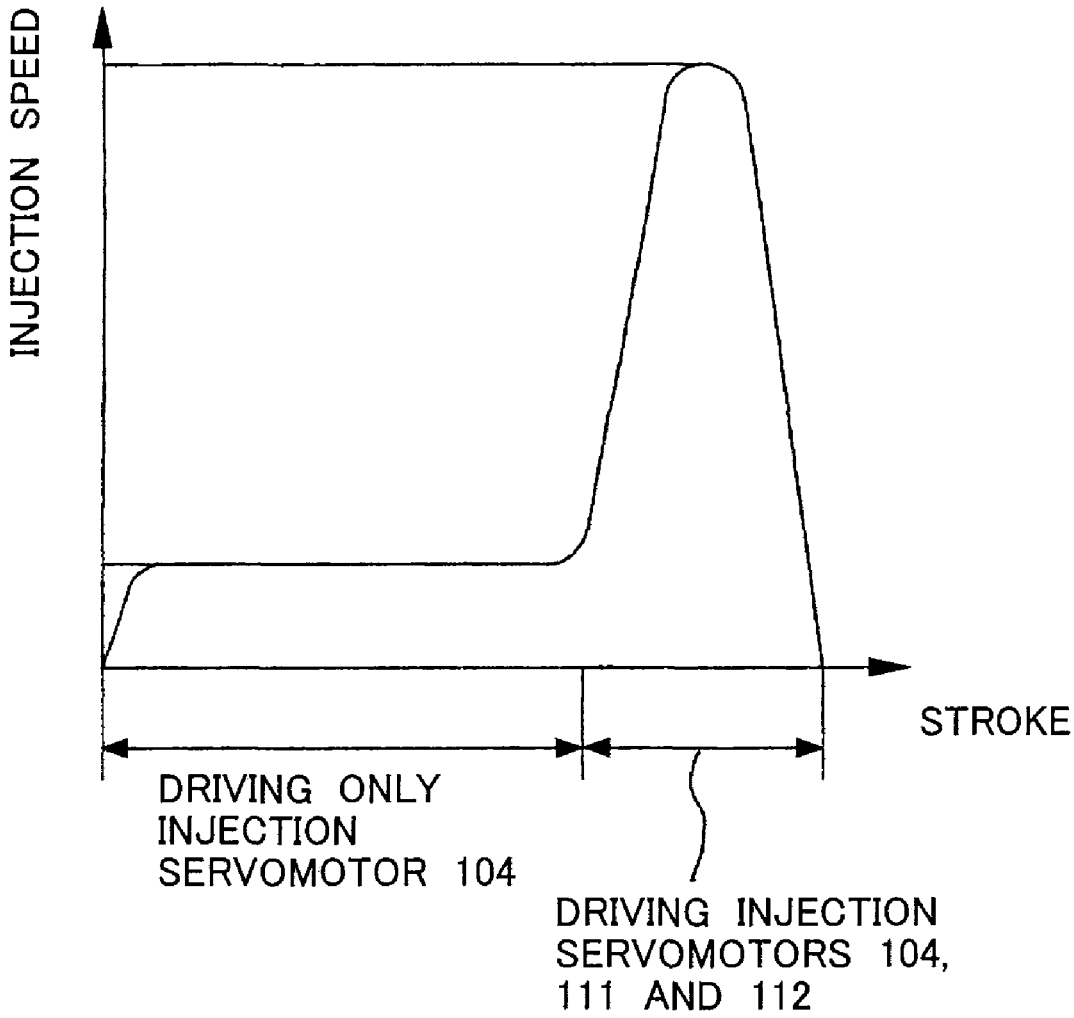
[FIG. 8] A graph showing changes in the speed and the pressure of an injection plunger in one molding cycle and changes in the speed and the force magnifying ratio of a crank rod mechanism in the injection unit according to the embodiment.

Accordingly, as shown in FIG. 8, the forward moving speed of the plunger 118 is low when the plunger 118 is driven only by the driving force of the first injection servomotor 104, and high when the plunger 118 is driven by the total driving force of the first to third injection servomotors 104, 111 and 112.

In this manner, the plunger 118 is driven by the first to third injection servomotors 104, 111 and 112 in the die casting machine according to this embodiment. Accordingly, the structure of the die casting machine can be simplified because any accumulator and any hydraulic oil pipeline provided in the background art are not required, while the speed of the plunger 118 can be controlled strictly. In addition, the driving force of the second and third injection servomotors 111 and 112 is transmitted to the plunger 118 through the crank mechanism constituted by the first arm 113 and the second arm 116. Thus, a predetermined injection speed (e.g. maximum speed 6,000 mm/sec) and a predetermined thrust (e.g. 160 KN) required for injecting a melt and boosting the pressure thereof can be obtained.

Although the two injection servomotors 111 and 112 are mounted on the linear motion body 106 in the aforementioned embodiment, it will be enough if one of the injection servomotors is provided when there is an excess of the moving speed or the thrust of the plunger 118.

In addition, in the aforementioned embodiment, the ball screw mechanism 110 is used as a motion converting mechanism for converting the rotational motion of the first injection servomotor 104 into rectilinear motion of the linear motion body 106, the second injection servomotor 111 and the third injection servomotor 112. In place of that configuration, it may be possible to use a crank mechanism constituted by a first arm which can be rotationally driven by the first injection servomotor 104, a second arm which has one end rotatably pin-connected to the first connecting shaft of the first arm and the other end rotatably pin-connected to the linear motion body 106, and sealed bearings which are provided in the pin-connection portions. According to such a configuration, the tolerance of the motion converting mechanism against dust or atomized liquid can be enhanced so that the die casting machine can be made low in cost and easy in maintenance.

Next, description will be made on the mold clamping unit 200 of the die casting machine according to the embodiment.

Figure 9:
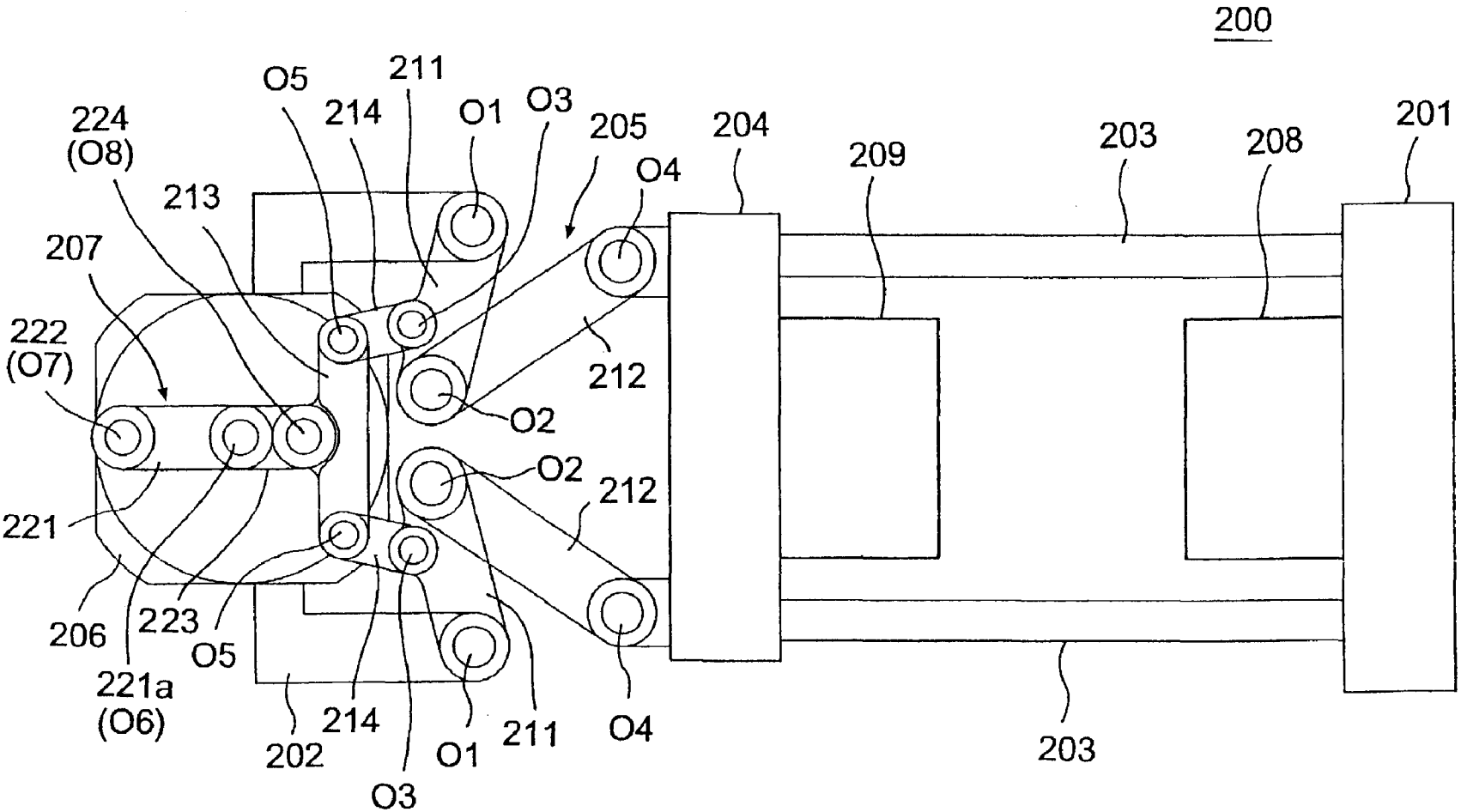
[FIG. 9] An explanatory view showing a state where a mold is opened by a mold clamping unit according to the embodiment.
Figure 10:
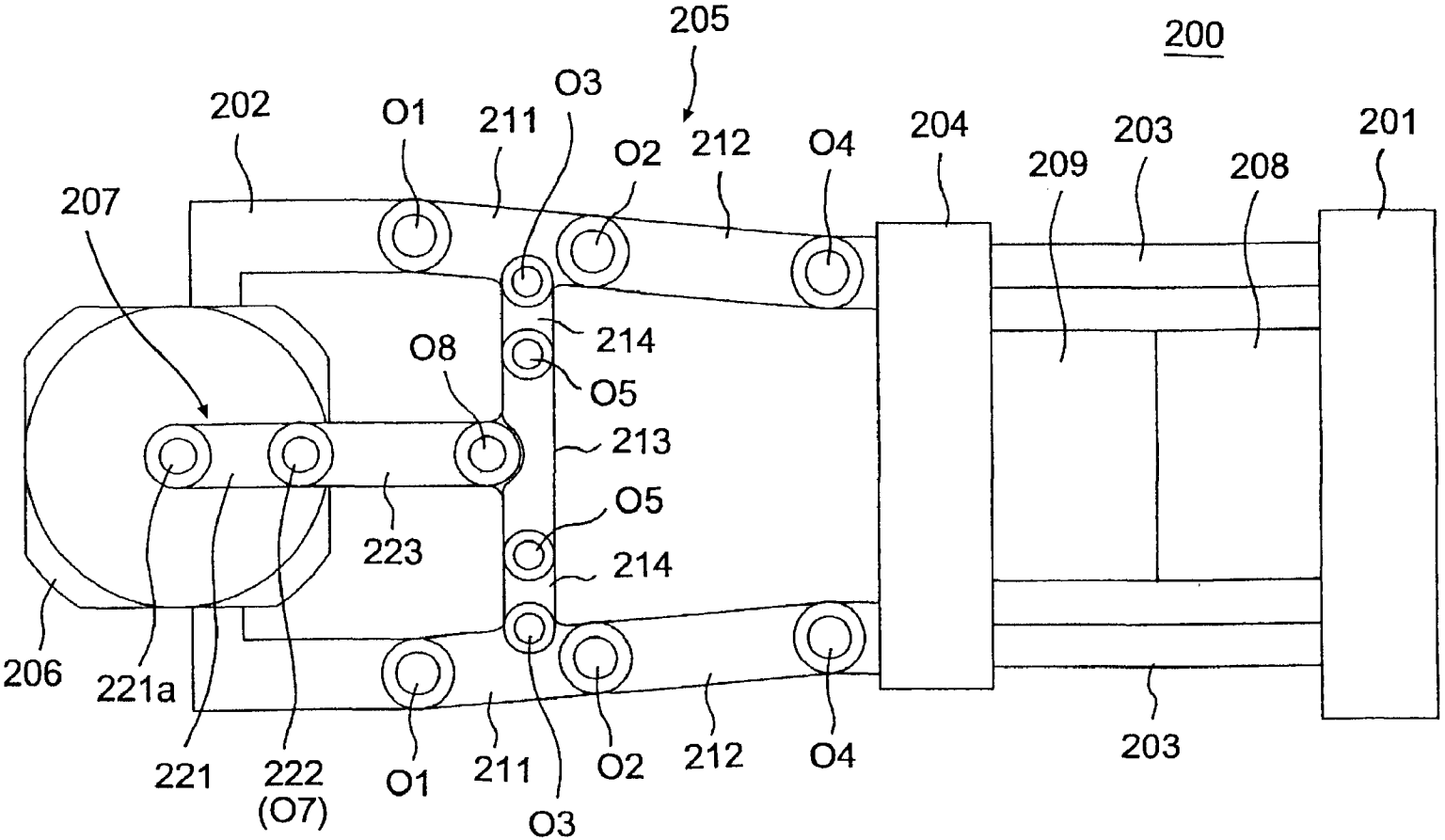
[FIG. 10] An explanatory view showing a state where the mold is closed by the mold clamping unit according to the embodiment.

As shown in FIGS. 9 and 10, the mold clamping unit 200 according to the embodiment has a fixed die plate 201, a tail stock 202, a plurality of tie bars 203, a movable die plate 204, a toggle link mechanism 205, an electric servomotor (mold clamping servomotor) 206, and a crank mechanism 207. The fixed die plate 201 and the tail stock 202 are fixed onto a not-shown bed of the machine. The opposite ends of the tie bars 203 are fixed to the fixed die plate 201 and the tail stock 202. The movable die plate 204 is guided by the tie bars 203 so as to move forward/backward between the fixed die plate 201 and the tail stock 202. The toggle link mechanism 205 links the tail stock 202 with the movable die plate 204. The electric servomotor 206 is mounted on the tail stock 202 and serves as a drive source for opening/closing molds and clamping the molds. The crank mechanism 207 converts rotational motion of the electric servomotor 206 into rectilinear motion and transmits the rectilinear motion to the toggle link mechanism 205. The fixed mold 208 is mounted on the fixed die plate 201, and the movable mold 209 is mounted on the movable die plate 204. A rotary encoder (not shown) serving as a rotation angle detecting sensor is provided in the mold clamping servomotor 206.

The toggle link mechanism 205 is constituted by a B link 211 which has one end rotatably pin-connected to the tail stock 202, an A link 212 which has one end rotatably pin-connected to the movable die plate 204 and the other end pin-connected to the other end of the B link 211 so as to rotate relatively, a cross head 213 to which the driving force of the electric servomotor 206 is applied through the crank mechanism 207, and a C link 214 which has one end rotatably pin-connected to the cross head 213 and the other end pin-connected to an intermediate portion of the B link 211 so as to rotate relatively. The reference sign O1 represents a pin connection portion of the B link 211 to the tail stock 202; O2, a pin connection portion of the A link 212 to the B link 211; O3, a pin connection portion of the C link 214 to the B link 211; O4, a pin connection portion of the A link 212 to the movable die plate 204; and O5, a pin connection portion of the C link 214 to the cross head 213. It is desirable that each pin connection portion O1 to O5 is provided with a sealed bearing in order to avoid bad effect of dust or atomized liquid. Thus, the toggle link mechanism 205 according to this embodiment has the A link 212, the B link 211 and the C link 214 and serves as a link mechanism with a five-point support structure including five pin connection portions O1 to O5. However, the gist of the invention is not limited thereto. It is a matter of course that a toggle link mechanism of another type may be provided.

Similarly to the aforementioned first to third injection servomotors 104, 111 and 112, a closed type built-in motor which is constituted by a casing, a cylindrical motor stator fixed to an inner surface of the casing, a motor coil wound around an outer circumference of the motor stator, a cylindrical motor rotor disposed in the motor stator and a motor magnet attached to an outer surface of the motor rotor and which has maximum torque higher than 300% of rated torque is used as the mold clamping servomotor 206.

The crank mechanism 207 is constituted by a first arm 221 whose rotating shaft 221*a* is connected to the motor rotor of the mold clamping servomotor 206 and a second arm 223 which has one end rotatably pin-connected to a first connecting shaft (eccentric shaft) 222 formed in the first arm 221 and the other end rotatably pin-connected to a second connecting shaft 224 formed in the cross head 213. It is desirable that a sealed bearing is provided in each of pin connection portions O7 and O8 so as to more reduce the effect of dust or the like.

FIG. 9 is a view showing the state of the crank mechanism 207 in a mold opening state, and FIG. 10 is a view showing the state of the crank mechanism 207 in a mold closing state. As shown in FIG. 9, in the mold opening state, the pin connection portion O7 between the first connecting shaft 222 and the second arm 223 and the pin connection portion O8 between the second arm 223 and the cross head 213 are disposed on the opposite sides of the rotation center O6 of the mold clamping servomotor 206 (first arm 221) so that the crank mechanism 207 is folded. On the other hand, in the mold closing state, as shown in FIG. 10, the rotation center O6 of the mold clamping servomotor 206 (first arm 221), the pin connection portion O7 between the first connecting shaft 222 and the second arm 223 and the pin connection portion O8 between the second arm 223 and the cross head 213 are disposed in this order so that the crank mechanism 207 is unfolded.

The control unit 400 stores rotation angles of the first arm 221 for controlling the drive torque of the mold clamping servomotor 206. In the range of the stored rotation angles, the mold clamping servomotor 206 is driven to output torque higher than rated torque, for example, to output maximum torque. In the other angle range, the mold clamping servomotor 206 is driven to output torque not higher than the rated torque. Thus, a required mold clamping force can be given to the mold clamping unit 200 at required timing.

Figure 11:
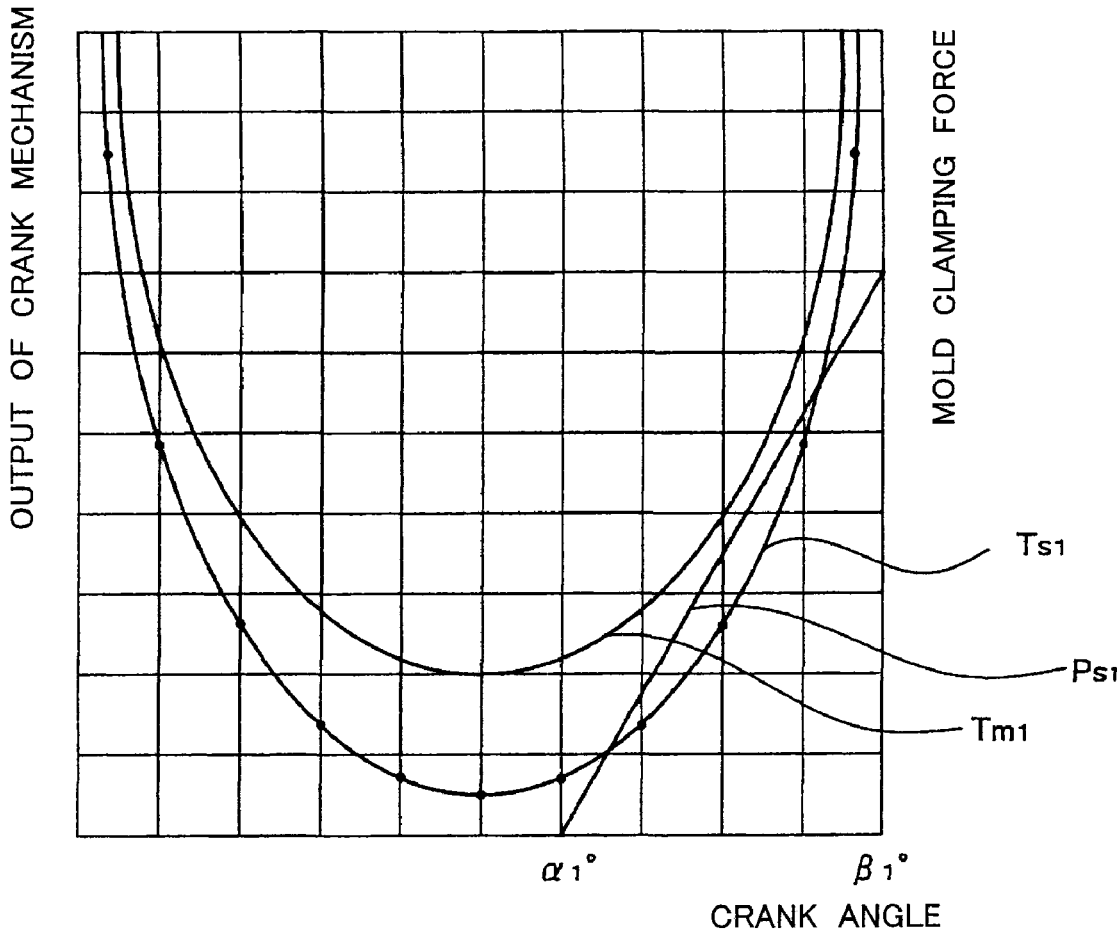
[FIG. 11] A graph showing the relation between a crank angle and an output of a crank rod mechanism and the relation between the crank angle and a mold clamping force in a mold clamping step.

For example, assume that the rotation angle θ of the first arm is set as 0□ when the pin connection portion O7 between the first connecting shaft 222 and the second arm 223, the rotation center O6 of the first arm 221 and the pin connection portion O8 between the second arm 223 and the cross head 213 are disposed in a straight line in this order (see FIG. 9). In addition, as shown in FIG. 11, assume that the rotation angle θ of the first arm 221 is set as α1□ when the fixed mold 208 and the movable mold 209 are closed, and the rotation angle θ of the first arm 221 is set as β1□ when a required mold clamping force is given between the fixed mold 208 and the movable mold 209. In the angle range of α1□≦θ≦β1□, the mold clamping servomotor 206 is driven to output torque higher than the rated torque, for example, to output maximum torque as shown by a curve Tm1. In the other angle range than α1□≦θ≦β1□, the mold clamping servomotor 206 is driven to output torque not higher than the rated torque as shown by a curve Ts1. Thus, the fixed mold 208 and the movable mold 209 can be closed quietly, and a mold clamping force P1 required for performing the injection step can be given between the fixed mold 208 and the movable mold 209.

According to such a configuration, the crank mechanism 207 provided with the sealed bearings is used as a motion converting mechanism for converting rotational motion of the mold clamping servomotor 206 into rectilinear motion of the movable die plate 204, so that tolerance against dust or atomized liquid can be enhanced as compared with that in the case where a ball screw mechanism is used. It is therefore unnecessary to cover the periphery of the crank mechanism 207 with a closed structure, and it is possible to reduce labor required for maintenance. Thus, the cost of the die casting machine can be made lower and the maintenance thereof can be made easier. In addition, a motor whose maximum torque is higher than 300% of rated torque is provided as the mold clamping servomotor 206, while rotation angles θ=α1□ and β1□ of the first arm 221 are set in the control unit 400 to control driving of the mold clamping servomotor 206. The mold clamping servomotor 206 is driven to output torque higher than the rated torque in the angle range of α1□≦θ≦β1□, and the mold clamping servomotor 206 is driven to output torque not higher than the rated torque in the other angle range than α1□≦θ≦β1□. Thus, a required mold clamping force can be obtained with a small motor whose rated torque is small, so that the die casting machine can be made smaller in size and lower in cost.

Next, description will be made on the ejecting unit 300 of the die casting machine according to the embodiment.

As shown in FIGS. 12 to 15, the ejecting unit 300 according to the embodiment has an ejecting plate 301, a plurality of ejecting pins 302 planted in the ejecting plate 301, an electric servomotor (ejecting servomotor) 303 serving as a drive source of the ejecting plate 301, and a crank mechanism 304 for converting rotational motion of the ejecting servomotor 303 into rectilinear motion and transmitting the rectilinear motion to the ejecting plate 301. The ejecting plate 301 and the crank mechanism 304 are disposed in an ejecting unit receiving space 305 formed in the movable die plate 204. The ejecting pins 302 pass through and are disposed in pin insertion holes 306 provided in the movable plate 204. Incidentally, a rotary encoder (not shown) serving as a rotation angle detecting sensor is provided in the ejecting servomotor 303.

In the same manner as the mold clamping servomotor 206, a closed type built-in motor which is constituted by a casing, a cylindrical motor stator fixed to an inner surface of the casing, a motor coil wound around an outer circumference of the motor stator, a cylindrical motor rotor disposed in the motor stator and a motor magnet attached to an outer surface of the motor rotor and which has maximum torque higher than 300% of rated torque is used as the ejecting servomotor 303.

Figure 12:
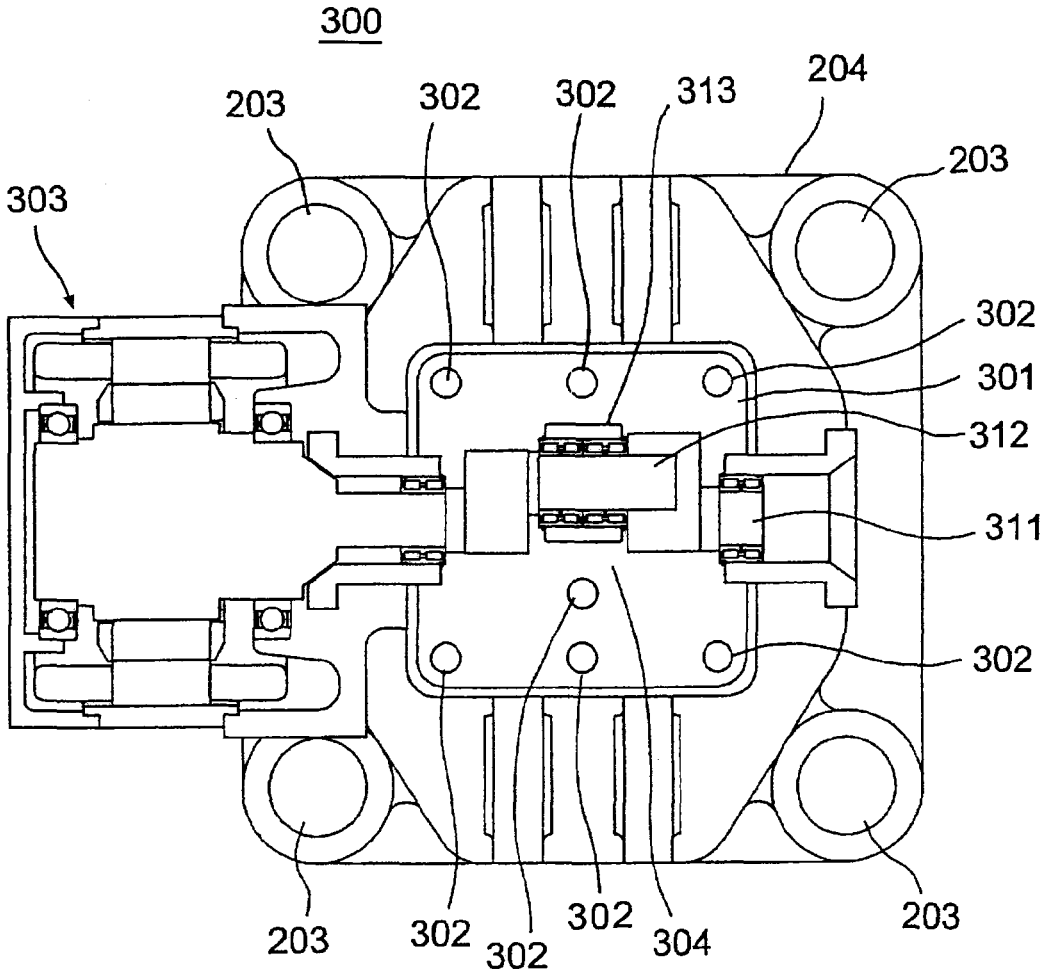
[FIG. 12] A sectional view showing a configuration of an ejecting unit according to the embodiment.

As shown in FIG. 12, the crank mechanism 304 is constituted by a first arm 311 connected to the motor rotor of the ejecting servomotor 303, a second arm 313 one end of which is rotatably pin-connected to a first connecting shaft 312 and the other end of which is rotatably pin-connected to the ejecting plate 301, and not-shown sealed bearings provided in pin connection portions O10 and O11 respectively.

Figure 13:
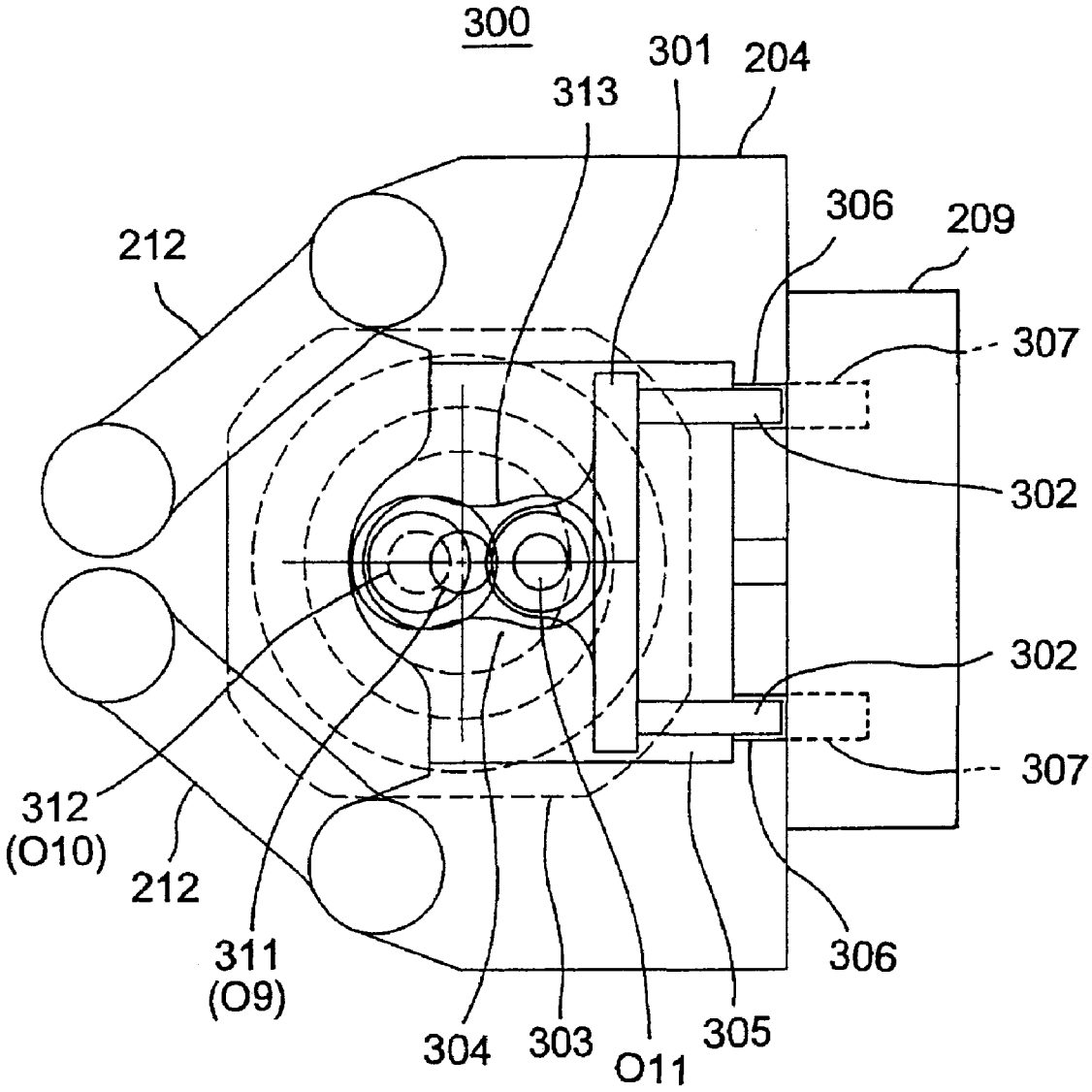
[FIG. 13] A view showing a state of a crank rod mechanism before the start of ejecting.
Figure 14:
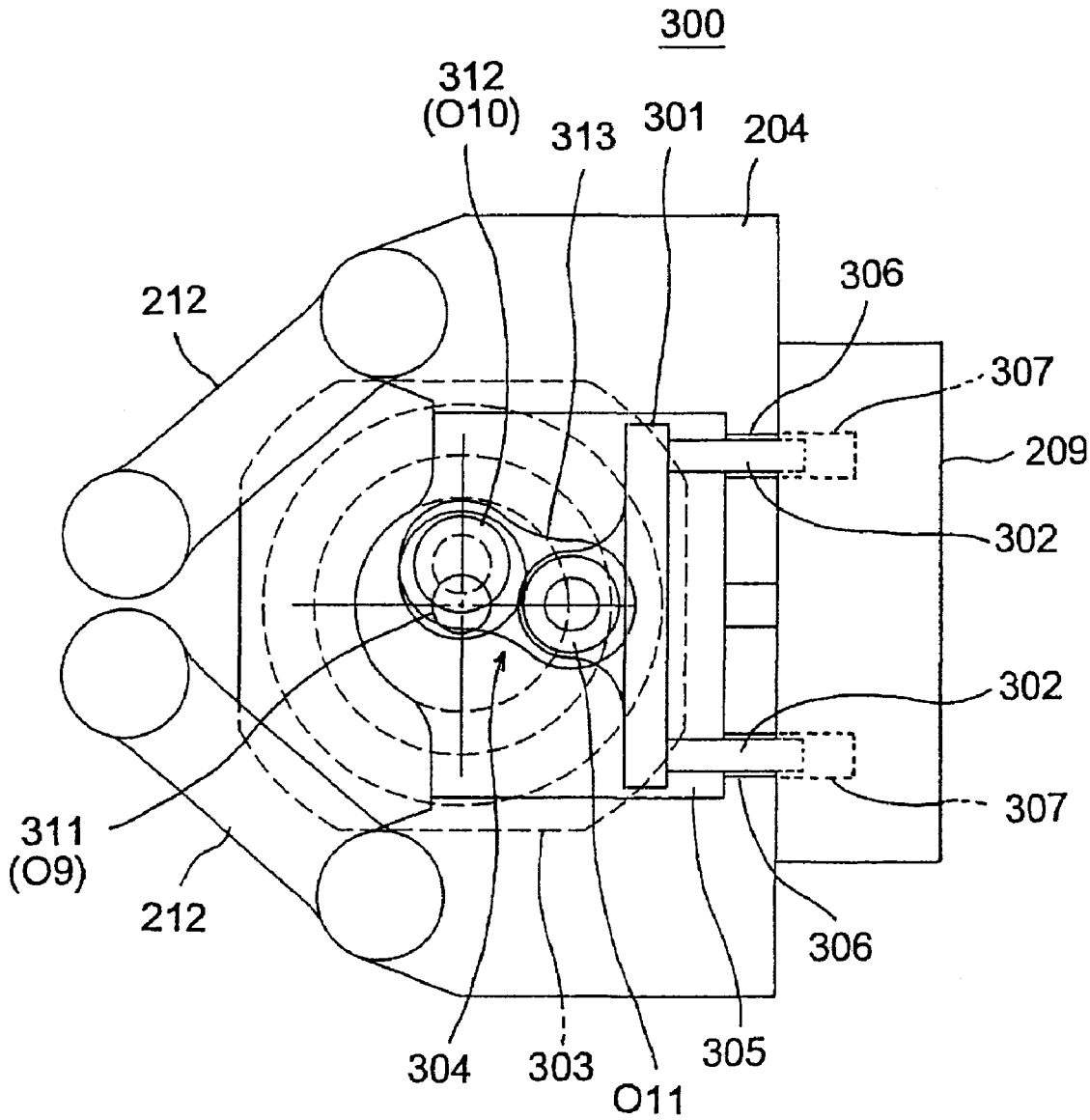
[FIG. 14] A view showing a state of the crank rod mechanism during the ejecting.
Figure 15:
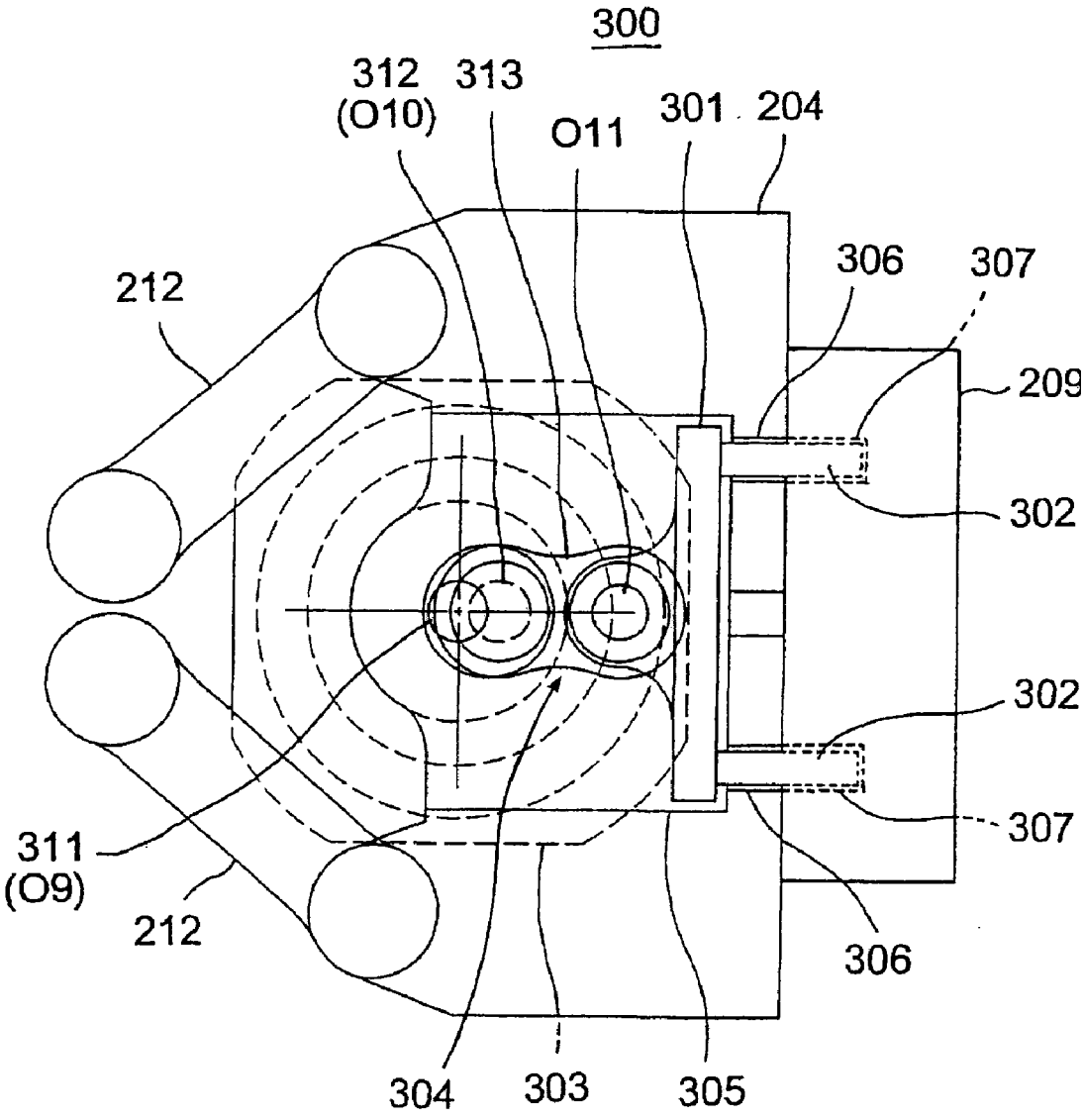
[FIG. 15] A view showing a state of the crank rod mechanism after completion of the ejecting.

FIG. 13 is a view showing a state of the crank mechanism 304 before the start of ejecting. FIG. 14 is a view showing a state of the crank mechanism 304 during the ejecting. FIG. 15 is a view showing a state of the crank mechanism 304 after completion of the ejecting. As shown in FIG. 13, before the start of ejecting, the pin connection portion O10 between the first connecting shaft 312 and the second arm 313 and the pin connection portion O11 between the second arm 313 and the ejecting plate 301 are disposed on the opposite sides of a rotation center O9 of the ejecting servomotor 303 (first arm 311). When the ejecting servomotor 303 is driven at that state to rotate the first arm 311, front end portions of the ejecting pins 302 are inserted into pin insertion holes 307 provided in the movable mold 209 so as to extrude a molded product with a not-shown ejecting plate of the mold, as shown in FIG. 14. Next, as shown in FIG. 15, the ejecting servomotor 303 is continuously driven until reaching a position where the rotation center O9 of the ejecting servomotor 303 (first arm 311), the pin connection portion O10 between the first connecting shaft 312 and the second arm 313 and the pin connection portion O11 between the second arm 313 and the ejecting plate 301 are disposed in this order. The molded product is then extracted from the movable mold 209. For the ejecting of the molded product, high pressure is required for a period till the molded product is released from the movable mold 209. In the other period, low pressure may be enough if it can press the ejecting plate 301 independently.

The control unit 400 stores rotation angles of the first arm 311 for controlling the drive torque of the ejecting servomotor 303. In the range of the stored rotation angles, the ejecting servomotor 303 is driven to output toque higher than rated torque, for example, to output maximum torque. In the other angle range, the ejecting servomotor 303 is driven to output torque not higher than the rated torque. In this manner, a required ejecting force can be given to the ejecting unit 300 at required timing.

Figure 16:
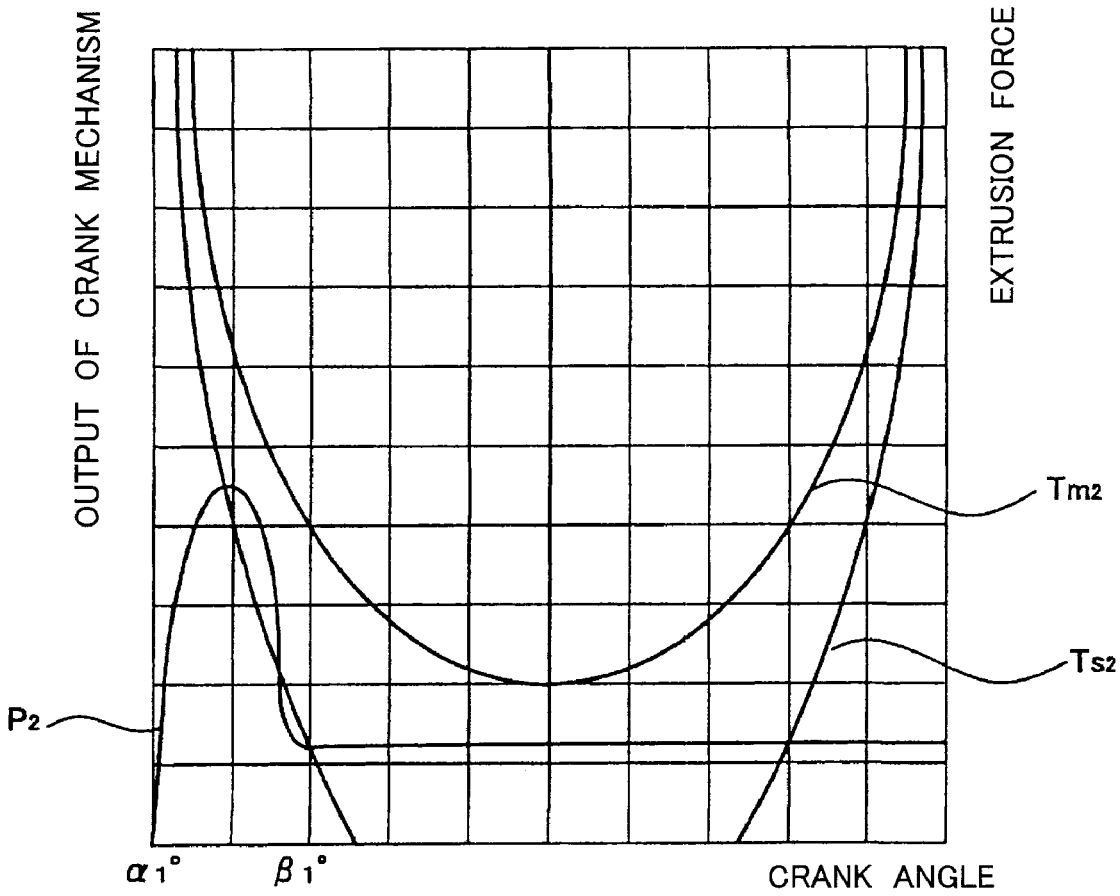
[FIG. 16] A graph showing the relation between a crank angle and an output of the crank rod mechanism and the relation between the crank angle and a mold clamping force in an ejecting step.

For example, assume that the rotation angle θ of the first arm is set as 0□ when the pin connection portion O10 between the first connecting shaft 312 and the second arm 313, the rotation center O9 of the first arm 311 and the pin connection portion O11 between the second arm 313 and the ejecting plate 301 are disposed in a straight line in this order (see FIG. 13). In addition, as shown in FIG. 16, assume that the rotation angle θ of the first arm 311 is set as α2□ when the front end portion of a not-shown ejecting plate provided in the mold abuts against the surface of a molded product, and the rotation angle θ of the first arm 311 is set as β2□ when the molded product is released from the movable mold 209. In the angle range of α2□≦θ≦β2□, the ejecting servomotor 303 is driven to output torque higher than rated torque, for example, to output maximum torque as shown by a curve Tm2. In the other angle range than α2□≦θ≦β2□, the ejecting servomotor 303 is driven to output torque not higher than the rated torque as shown by a curve Ts2. Thus, a large ejecting force P2 required for releasing the molded product can be given to the ejecting plate 301.

According to such a configuration, the crank mechanism 304 provided with the sealed bearings is used as a motion converting mechanism for converting rotational motion of the ejecting servomotor 303 into rectilinear motion of the ejecting plate 301, so that tolerance against dust or atomized liquid can be enhanced as compared with that in the case where a ball screw mechanism is used. It is therefore unnecessary to cover the periphery of the crank mechanism 304 with a closed structure, and it is possible to reduce labor required for maintenance. Thus, the cost of the die casting machine can be made lower and the maintenance thereof can be made easier. In addition, a motor whose maximum torque is higher than 300% of rated torque is provided as the ejecting servomotor 303, while rotation angles θ=α2□ and β2□ of the crank are set in the control unit 400 to control driving of the ejecting servomotor 303. The ejecting servomotor 303 is driven to output torque higher than the rated torque, for example, to output maximum torque in the angle range of α2□≦θ≦β2□, and the ejecting servomotor 303 is driven to output torque not higher than the rated torque in the other angle range than α2□≦θ≦β2□. Thus, a required ejecting force can be obtained by use of a small motor whose rated torque is small, so that the die casting machine can be made smaller in size and lower in cost.

Incidentally, in the aforementioned embodiment, configuration is made in such a manner that the ejecting unit 300 is provided, and a molded product is extruded from the movable mold 209 by the ejecting unit 300. The gist of the invention is not limited thereto. Configuration may be made in such a manner that a molded product is pressed by the plunger 118 provided in the injection unit 100 and the molded product is extracted from the fixed mold 208.

Description Of Reference Numerals

100 injection unit
104 first injection servomotor
111 second injection servomotor
112 third injection servomotor
113 first arm
115 first connecting member
116 second arm
117 second connecting member
118 injection plunger
200 mold clamping unit
204 movable die plate

205 toggle link mechanism
206 mold clamping servomotor
207 crank mechanism
300 ejecting unit
301 ejecting plate
302 ejecting pin
303 ejecting servomotor
304 crank mechanism
400 control unit
401 motor drive circuit

The invention claimed is:

1. A die casting machine comprising: an electric servomotor for injection in a first stage, which is fixed to a motor mounting plate; a motion converting mechanism in the first stage, which converts rotational motion of the electric servomotor for injection in the first stage into rectilinear motion of a linear motion body; an electric servomotor for injection in a second stage, which is mounted on the linear motion body; a motion converting mechanism in the second stage, which converts rotational motion of the electric servomotor for injection in the second stage into rectilinear motion of an injection plunger; and a control unit which controls driving of the electric servomotors for injection; the die casting machine being characterized in that:

the control unit drives only the electric servomotor for injection in the first stage independently in a low-speed injection step, and drives both the electric servomotor for injection in the first stage and the electric servomotor for injection in the second stage simultaneously in a high-speed injection step and a pressure intensification step.

2. A die casting machine according to claim 1, characterized in that: one of the motion converting mechanism in the first stage and the motion converting mechanism in the second stage is a crank mechanism which includes a first arm and a second arm, the first arm being rotationally driven by the electric servomotor for injection in the first stage or the electric servomotor for injection in the second stage, the second arm having one end rotatably linked with the first arm and the other end rotatably linked with the linear motion body or the injection plunger.

3. A die casting machine according to claim 2, characterized in that: an initial position of the crank mechanism is set so that the high-speed injection step can be carried out in a rotational angle range of the first arm where a relative speed of the linear motion body or the injection plunger is the highest, and the pressure intensification step can be carried out in a rotational angle range of the first arm where a magnifying ratio of force acting on the linear motion body or the injection plunger is the highest.

* * * * *